US006070677A

United States Patent [19]

Johnston, Jr.

[11] Patent Number: 6,070,677

[45] Date of Patent: Jun. 6, 2000

[54] METHOD AND APPARATUS FOR ENHANCING PRODUCTION FROM A WELLBORE HOLE

[75] Inventor: Hugh L. Johnston, Jr., Midland, Tex.

[73] Assignee: I.D.A. Corporation, Houston, Tex.

[21] Appl. No.: 08/982,853

[22] Filed: Dec. 2, 1997

[51] Int. Cl.[7] ..... E21B 7/28

[52] U.S. Cl. ..... 175/57; 175/263; 175/265; 175/325.1; 166/174

[58] Field of Search ..... 175/265, 263, 175/275, 424, 325.1, 238, 292, 53, 57; 166/311, 55.7, 174, 173; 408/146, 147, 187, 188; 82/1.2, 1.4, 1.5

[56] References Cited

U.S. PATENT DOCUMENTS

| | | | |
|---|---|---|---|
| 2,018,284 | 10/1935 | Schweitzer et al. | 175/54 |
| 2,450,223 | 9/1948 | Barbour | 175/271 |
| 2,499,521 | 3/1950 | Morrison | 408/188 |
| 2,634,957 | 4/1953 | Coyle | 175/25 |
| 2,809,015 | 10/1957 | Phipps | 175/232 |
| 2,847,189 | 8/1958 | Shook | 175/267 |
| 3,117,626 | 1/1964 | Ringler | 166/55.7 |
| 3,386,521 | 6/1968 | Chadderdon et al. | 175/269 |
| 3,731,753 | 5/1973 | Weber | 175/285 |
| 3,757,876 | 9/1973 | Pereau | 175/267 |
| 4,064,951 | 12/1977 | Weber | 175/45 |
| 4,169,510 | 10/1979 | Meigs | 175/65 |
| 4,189,184 | 2/1980 | Green | 299/8 |
| 4,589,504 | 5/1986 | Simpson | 175/267 |
| 4,614,242 | 9/1986 | Rives | 175/269 |
| 4,618,009 | 10/1986 | Carter et al. | 175/267 |
| 4,693,328 | 9/1987 | Furse et al. | 175/275 |
| 4,976,323 | 12/1990 | Kitchens | 175/267 |
| 5,368,114 | 11/1994 | Tandberg et al. | 175/267 |
| 5,402,856 | 4/1995 | Warren et al. | 175/57 |
| 5,494,121 | 2/1996 | Nackerud | 175/263 |

FOREIGN PATENT DOCUMENTS

| | | |
|---|---|---|
| 0 771 932 A1 | 5/1997 | European Pat. Off. . |
| 95/03473 | 2/1995 | WIPO . |

*Primary Examiner*—Eileen Dunn Lillis
*Assistant Examiner*—John Kreck
*Attorney, Agent, or Firm*—Tobor, Goldstein & Healey, L.L.P.

[57] ABSTRACT

An apparatus for enhancing production from a wellbore hole may include a body member having at least one cutting assembly. Each cutting assembly may have an upper, middle, and lower cutting arm. The cutting arms are hingedly connected to one another. An upper end of each upper cutting arm is hingedly connected to the body member. A lower end of each lower cutting arm is hingedly connected to a corresponding beveled attachment that is slidably received within a corresponding beveled groove in the body member. The body member includes an interior longitudinal bore in fluid communication with a jet nozzle that is located beneath each cutting assembly. The apparatus is connected to a drill string. As the drill string is rotated, each cutting assembly is moved to a fully-deployed position under centrifugal force, thereby enlarging the wellbore hole. Drilling fluid may be pumped into the apparatus to generate hydraulic power to carry loose cuttings to the surface. The body member may include an aperture to establish fluid communication between the longitudinal bore and an upper end of each beveled groove. When the beveled attachments have slidably moved to the upper ends of the beveled grooves, the apertures will be covered thereby restricting fluid flow therethrough and creating an increase in pressure within the longitudinal bore. This pressure increase provides an indication that the cutting assemblies are in their fully-deployed positions, at which time a downward force is applied to the apparatus to further enlarge the wellbore.

35 Claims, 6 Drawing Sheets

13
17
21
64
19
15
11
14
18
20
12
24
34
22
32
2
2
40
36
30
38
29
54
46
42
44
10
48
50
68
28
68
26
60
52
52
16
62
15
11
66

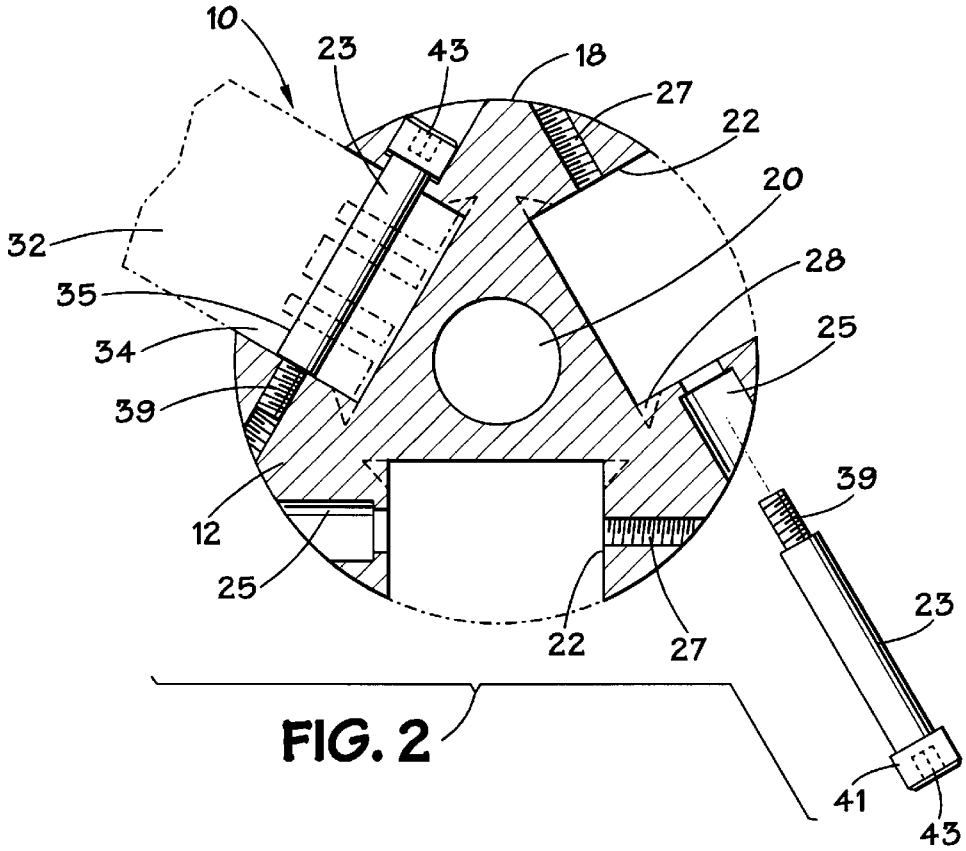
FIG. 2
FIG. 9
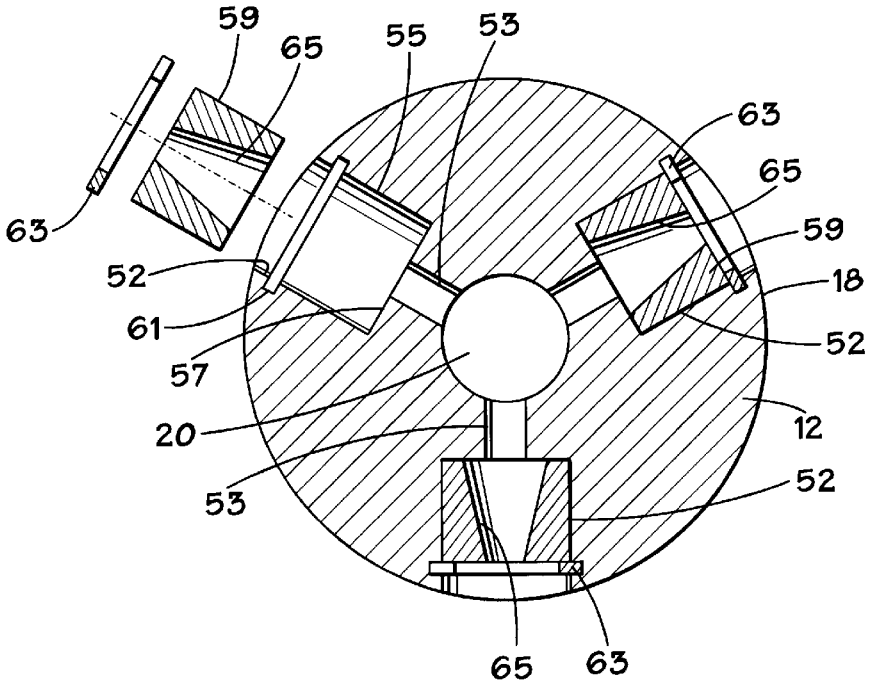

20
29
50
54
8
56
8
28
22
32
26
12
60
9
18
9
59
52
53

METHOD AND APPARATUS FOR ENHANCING PRODUCTION FROM A WELLBORE HOLE

BACKGROUND OF THE INVENTION

1. Field of the Invention

The present invention relates generally to downhole drilling equipment, and more particularly to a method and apparatus for enhancing production from a wellbore hole.

2. Description of the Related Art

It is well known in the oil industry that after a well has been drilled, casing is lowered into the wellbore hole and cemented in place. Thereafter, perforations are normally placed in the casing adjacent a formation holding hydrocarbons. The hydrocarbons then flow through the perforations into the casing and are produced to the earth's surface, in a manner well known to those of skill in the art. After a period of time, as the hydrocarbons are depleted from the formation, the amount of hydrocarbons flowing through the perforations dwindles to a degree that it may be no longer economically feasible to continue to operate the well. As such, there have been various attempts within the industry to develop new drilling and completion systems that render economically feasible the continued operation of the above-discussed partially-depleted wells. One approach has been to make the drainage surface area from which the hydrocarbons are produced greater than the drainage area provided by the perforations in the casing. Examples of various approaches to increasing drainage surface area may be found in U.S. Pat. No. 2,450,223 (Barbour), U.S. Pat. No. 4,618,009 (Carter et al.), and U.S. Pat. No. 5,494,121 (Nackerud). The concept of increasing drainage area to increase production applies not only to oil and gas wells, but also to other wells, such as water wells, and in other contexts, such as to a shaft for mining mineral deposits. For example, as disclosed in U.S. Pat. No. 4,189,184 (Green), it is known in the mining industry that it is desirous to increase the surface area within a mining shaft of the mineral deposit to be mined. While the approaches disclosed in the above-listed U.S. patents are directed to the broad concept of increasing drainage/mining surface area in order to increase production, it is believed that these approaches are not entirely satisfactory, and that an improved approach is warranted. As such, the primary object of the present invention is to provide a new and useful method and apparatus to increase production of oil, gas, water, mineral deposits, or the like from a well/shaft by increasing the surface area from which the fluids or mineral deposits are produced/mined.

SUMMARY OF THE INVENTION

The present invention has been contemplated to meet the above-described needs. In a broad aspect, the invention is an apparatus for enhancing production from a wellbore hole comprising: a body member having a first end, a second end, an outer surface, a longitudinal bore extending therethrough, and at least one cutting-arm slot disposed longitudinally in the outer surface of the body member, the cutting-arm slot having a first end and a second end; and at least one cutting assembly disposed within the at least one cutting-arm slot, the at least one cutting assembly including: an upper cutting arm having a first end and a second end, the first end of the upper cutting arm being hingedly attached to the body member adjacent the first end of the at least one cutting-arm slot; a middle cutting arm having a first end and a second end, the first end of the middle cutting arm being hingedly attached to the second end of the upper cutting arm; and, a lower cutting arm having a first end and a second end, the first end of the lower cutting arm being hingedly attached to the second end of the middle cutting arm, and the second end of the lower cutting arm being slidably and hingedly attached to the second end of the body member. Another feature of this aspect of the present invention is that the body member may further include a groove disposed adjacent the second end of the at least one cutting-arm slot, and the apparatus may further include an attachment disposed for longitudinal movement within the groove and hingedly attached to the second end of the lower cutting arm. Another feature of this aspect of the present invention is that the body member may further include at least one aperture adjacent a first end of the groove, the at least one aperture establishing fluid communication between the longitudinal bore and the first end of the groove, the aperture being covered by the attachment when the at least one cutting arm assembly is in a fully-deployed position thereby prohibiting communication of fluid from the longitudinal bore through the aperture and causing an increase in fluid pressure within the longitudinal bore, the pressure increase providing an indication that the at least one cutting arm assembly is in its fully-deployed position. Another feature of this aspect of the present invention is that the apparatus may further include an access plate removably attached to the body member adjacent the second end of the at least one cutting-arm slot to allow insertion of the attachment into the groove. Another feature of this aspect of the present invention is that the groove and attachment may be beveled. Another feature of this aspect of the present invention is that the apparatus may further include at least one fluid flowpath disposed in the body member below the at least one cutting assembly, the at least one fluid flowpath establishing fluid communication between the longitudinal bore and the outer surface of the body member. Another feature of this aspect of the present invention is that the at least one fluid flow path is upwardly angled away from the longitudinal bore to the outer surface of the body member. Another feature of this aspect of the present invention is that the at least one fluid flow path is flared inwardly from the longitudinal bore to the outer surface of the body member. Another feature of this aspect of the present invention is that the at least one fluid flowpath may include a first section, and a second section, the apparatus further including a replaceable jet nozzle having an inwardly flared aperture, the jet nozzle being removably received within the second section of the at least one fluid flowpath. Another feature of this aspect of the present invention is that the at least one fluid flowpath may further include a shoulder disposed between the first and second sections, the second section further including an annular groove for receiving a snap ring, the jet nozzle being held in place between the shoulder and the snap ring when the snap ring is seated within the annular groove. Another feature of this aspect of the present invention is that the cutting arms may further include cutting inserts attached to leading edges of the cutting arms. Another feature of this aspect of the present invention is that the body member may include three cutting assemblies disposed in three cutting-arm slots, the three cutting-arm slots being spaced apart equally about the circumference of the body member. Another feature of this aspect of the present invention is that the body member may include an access bore and a threaded bore adjacent the first end of the at least one cutting-arm slot, the apparatus further including a hinge pin having a threaded end for mating with the threaded bore and a head end to be received in the access bore, the hinge pin passing through an aperture in the upper end of the first cutting arm. Another feature of this aspect of the present invention is that the apparatus may further include an open hole stabilizer disposed about the outer surface of the body member to stabilize the apparatus during operation. Another feature of this aspect of the present invention is that the apparatus may further include a pilot bit attached to the second end of the body member.

In another aspect, the present invention may be an apparatus for enhancing production from a wellbore hole comprising: a body member having a first end, a second end, an outer surface, a longitudinal bore extending therethrough, and at least one cutting-arm slot disposed longitudinally in the outer surface of the body member, the cutting-arm slot having a first end and a second end; and at least one cutting assembly disposed within the at least one cutting-arm slot, the at least one cutting assembly including: an upper cutting arm having a first end and a second end, the first end of the upper cutting arm being hingedly attached to the body member adjacent the first end of the at least one cutting-arm slot; and a lower cutting arm having a first end and a second end, the first end of the lower cutting arm being hingedly attached to the second end of the upper cutting arm, and the second end of the lower cutting arm being slidably and hingedly attached to the second end of the body member. Another feature of this aspect of the present invention is that the body member may further include a groove disposed adjacent the second end of the at least one cutting-arm slot, and the apparatus may further include an attachment disposed for longitudinal movement within the groove and hingedly attached to the second end of the lower cutting arm. Another feature of this aspect of the present invention is that the body member may further include at least one aperture adjacent a first end of the groove, the at least one aperture establishing fluid communication between the longitudinal bore and the first end of the groove, the aperture being covered by the attachment when the at least one cutting arm assembly is in a fully-deployed position thereby prohibiting communication of fluid from the longitudinal bore through the aperture and causing an increase in fluid pressure within the longitudinal bore, the pressure increase providing an indication that the at least one cutting arm assembly is in its fully-deployed position. Another feature of this aspect of the present invention is that the apparatus may further include an access plate removably attached to the body member adjacent the second end of the at least one cutting-arm slot to allow insertion of the attachment into the groove. Another feature of this aspect of the present invention is that the groove and attachment may be beveled. Another feature of this aspect of the present invention is that the apparatus may further include at least one fluid flowpath disposed in the body member below the at least one cutting assembly, the at least one fluid flowpath establishing fluid communication between the longitudinal bore and the outer surface of the body member. Another feature of this aspect of the present invention is that the at least one fluid flow path is upwardly angled away from the longitudinal bore to the outer surface of the body member. Another feature of this aspect of the present invention is that the at least one fluid flow path may be flared inwardly from the longitudinal bore to the outer surface of the body member. Another feature of this aspect of the present invention is that the at least one fluid flowpath may include a first section, and a second section, the apparatus further including a replaceable jet nozzle having an inwardly flared aperture, the jet nozzle being removably received within the second section of the at least one fluid flowpath. Another feature of this aspect of the present invention is that the at least one fluid flowpath may further include a shoulder disposed between the first and second sections, the second section further including an annular groove for receiving a snap ring, the jet nozzle being held in place between the shoulder and the snap ring when the snap ring is seated within the annular groove. Another feature of this aspect of the present invention is that the cutting arms may further include cutting inserts attached to leading edges of the cutting arms. Another feature of this aspect of the present invention is that the body member may include three cutting assemblies disposed in three cutting-arm slots, the three cutting-arm slots being spaced apart equally about the circumference of the body member. Another feature of this aspect of the present invention is that the body member may include an access bore and a threaded bore adjacent the first end of the at least one cutting-arm slot, the apparatus further including a hinge pin having a threaded end for mating with the threaded bore and a head end to be received in the access bore, the hinge pin passing through an aperture in the upper end of the first cutting arm. Another feature of this aspect of the present invention is that the apparatus may further include an open hole stabilizer disposed about the outer surface of the body member to stabilize the apparatus during operation. Another feature of this aspect of the present invention is that the apparatus may further include a pilot bit attached to the second end of the body member.

In yet another aspect, the present invention may be a method of using a production-enhancing apparatus to enhance production from a wellbore hole, the apparatus including a body member having a first end, a second end, an outer surface, a longitudinal bore extending therethrough, and at least one cutting-arm slot disposed longitudinally in the outer surface of the body member, the cutting-arm slot having a first end and a second end, and at least one cutting assembly disposed within the at least one cutting-arm slot, the at least one cutting assembly including an upper cutting arm having a first end and a second end, the upper end of the upper cutting arm being hingedly attached to the body member adjacent the first end of the at least one cutting-arm slot, and a lower cutting arm having a first end and a second end, the first end of the lower cutting arm being hingedly attached to the second end of the upper cutting arm, and the second end of the lower cutting arm being slidably and hingedly attached to the second end of the body member, the method comprising the steps of: attaching the production-enhancing apparatus to a drill string; lowering the drill string and production-enhancing apparatus into the wellbore hole; positioning the production-enhancing apparatus adjacent a producing formation; and, rotating the drill string and production-enhancing apparatus to cause the at least one cutting assembly to move from a closed position to a fully-deployed position and to cut into the formation, thereby enlarging a surface drainage area of the wellbore hole. Another feature of this aspect of the present invention is that the method may further include the step of pumping a drilling medium from the earth's surface down an interior of the drill string, through a longitudinal bore of the body member, through a drilling bit attached to the second end of the body member, and back to the earth's surface through an annulus between the drill string and the wellbore hole, while the drill string is rotating, to carry away debris loosened by the cutting arms. Another feature of this aspect of the present invention is that the apparatus may further include at least one fluid flowpath disposed in the body member below the at least one cutting assembly, the at least one fluid flowpath establishing fluid communication between the longitudinal bore and the outer surface of the body member, and wherein the step of pumping drilling medium further includes the step of pumping drilling medium through the at least one fluid flowpath. Another feature of this aspect of the present invention is that the production-enhancing apparatus may further include a groove disposed adjacent the second end of the at least one cutting-arm slot, an attachment disposed for longitudinal movement within the groove and hingedly attached to the second end of the lower cutting arm, and at least one aperture adjacent a first end of the groove establishing fluid communication between the longitudinal bore and the first end of the groove, and the method may further include the steps of: moving the attachment upwardly within the groove to cover the aperture when the at least one cutting arm assembly is in its fully-deployed position to thereby prohibit communication of fluid from the longitudinal bore through the aperture and causing an increase in fluid pressure within the longitudinal bore to provide an indication that the at least one cutting arm assembly is in its fully-deployed position; and, applying a downward force to the apparatus to cause the apparatus tool to move downwardly and further enlarge the wellbore hole. Another feature of this aspect of the present invention is that the method may further include the step of applying a downward force to the apparatus to cause the apparatus to move downwardly and further enlarge the wellbore hole. Another feature of this aspect of the present invention is that the method may further include the steps of: stopping the rotation of the drill string and apparatus; retracting the at least one cutting assembly under the force of gravity into the at least one cutting arm slot; and removing the drill string and apparatus from the wellbore hole. Another feature of this aspect of the present invention is that the method may further include the step of milling out a section of casing adjacent the producing formation prior to lowering the drill string and production-enhancing apparatus into the wellbore hole.

BRIEF DESCRIPTION OF THE DRAWINGS

FIG. 2 is a cross-sectional view taken along line 2—2 of FIG. 1.

FIG. 9 is a cross-sectional view taken along line 9—9 of FIG. 6.

Figure 1:
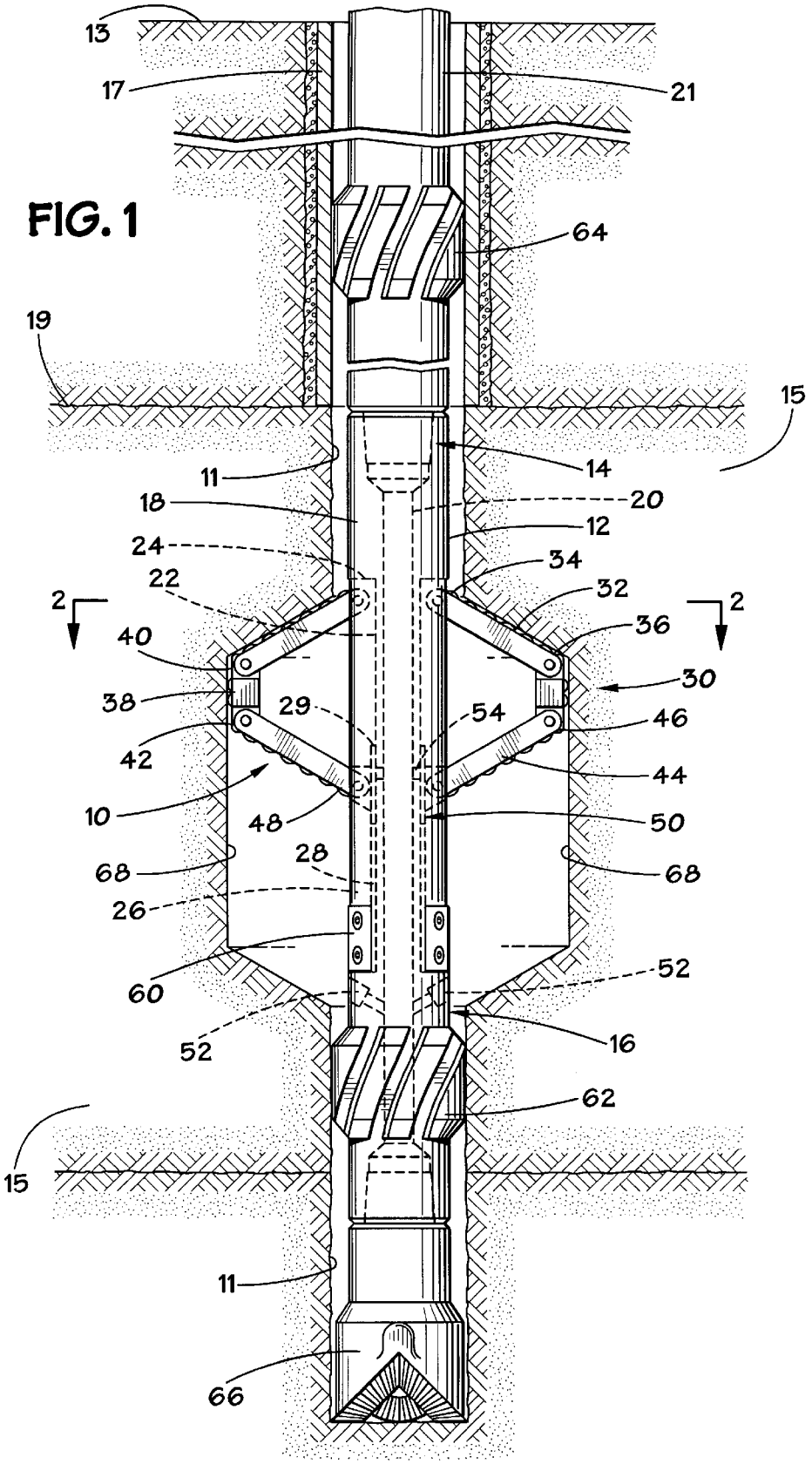
FIG. 1 is a longitudinal view of the apparatus of the present invention attached to a drill string and positioned in a wellbore hole with its cutting arms in fully-deployed positions.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Referring to the drawings in detail, wherein like numerals denote identical elements throughout the several views, the apparatus and method of the present invention will now be described.

The apparatus 10 of the present invention is shown in FIG. 1 located within a well bore hole 11 extending from the earth's surface 13 through a geographical formation 15 from which oil, gas, water, minerals, etc. are to be produced. Casing 17 extends from the earth's surface 13 within the wellbore 11 to an upper surface 19 of the formation 15. The apparatus 10 is attached to a drill string 21 and lowered into the well until the apparatus 10 is adjacent the formation 15. In FIG. 1, the apparatus 10 is shown in an open or fully-deployed position.

With reference to FIG. 1, a specific embodiment of the apparatus 10 of the present invention includes a body member 12 having a first end 14, a second end 16, an outer surface 18, a longitudinal bore 20 (best shown in FIG. 2) extending therethrough, at least one cutting-arm slot 22 disposed longitudinally in the outer surface 18 of the body member 12, the cutting-arm slot 22 having a first end 24 and a second end 26, and a beveled groove 28 (best shown in FIGS. 2, 6 and 8) disposed adjacent the second end 26 of the at least one cutting-arm slot 22. The apparatus 10 also includes at least one cutting assembly 30 disposed within the at least one cutting-arm slot 22. While the apparatus 10 of the present invention will be described hereinbelow as including at least one cutting assembly 30, in a specific embodiment, the apparatus 10 may be provided with three cutting assemblies 30 disposed in three cutting-arm slots 22 that are spaced apart equally about the circumference of the body member 12, as best shown in FIGS. 2, 6, and 8.

As shown in FIG. 1, in a specific embodiment, the at least one cutting assembly 30 includes: an upper cutting arm 32 having a first end 34 and a middle end 36; a second cutting arm 38 having a first end 40 and a second end 42; and a lower cutting arm 44 having a first end 46 and a second end 48. The first end 34 of the upper cutting arm 32 is hingedly attached, in a manner more fully explained below, to the body member 12 adjacent the first end 24 of the at least one cutting-arm slot 22. The first end 40 of the middle cutting arm 38 is hingedly attached to the second end 36 of the upper cutting arm 32. The first end 46 of the lower cutting arm 44 is hingedly attached to the second end 42 of the middle cutting arm 38. The first end 34 of the upper cutting arm 32 may be hingedly attached within the first end 24 of the at least one cutting arm slot 22 in any conventional manner as known to those of skill in the art. In a specific embodiment, as shown in FIG. 2, a hinge pin 23 may be threadably fastened to the body member 12. In this embodiment, the body member 12 is provided with an access bore 25 and a threaded bore 27 adjacent the first end 24 of the at least one cutting arm slot 22. The hinge pin 23 is provided with a threaded end 39 for mating with the threaded bore 27 and a head end 41 to be received in the access bore 25. In a specific embodiment, the head end 41 may be provided with a hex key slot 43. The head end 41 may be provided in other known configurations as will be readily apparent to those of skill in the art. The hinge pin 23 passes through an aperture 35 in the first end 34 of the upper cutting arm 32.

Figure 3:
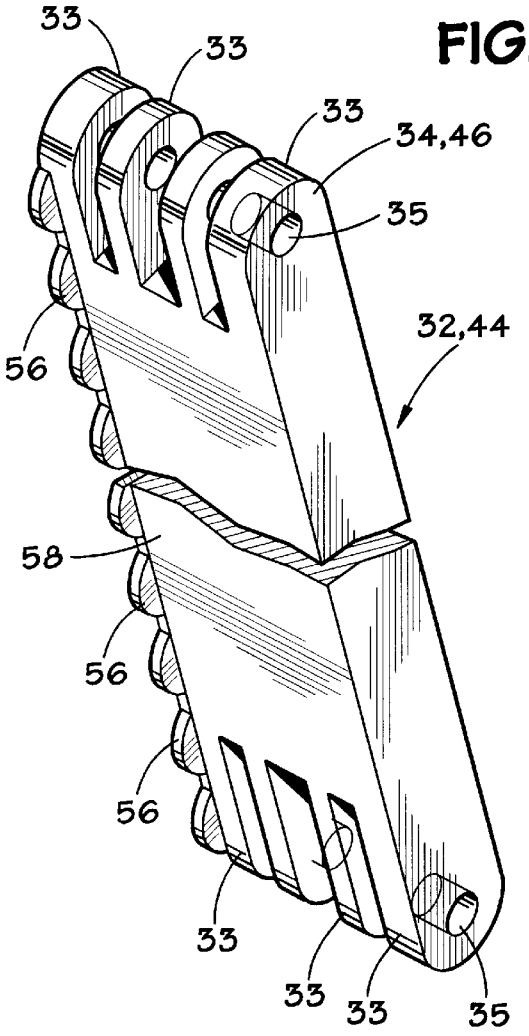
FIG. 3 illustrates an upper or a lower cutting arm of the apparatus of the present invention.
Figure 4:
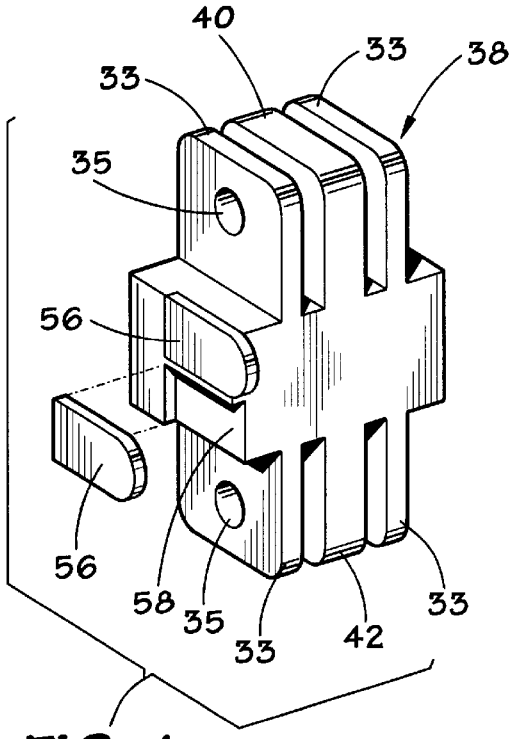
FIG. 4 illustrates a middle cutting arm of the apparatus of the present invention.

In a specific embodiment, the upper and lower cutting arms 32 and 44 may be identical in structure, as shown in FIG. 3. A specific embodiment of the middle cutting arm 38 is shown in FIG. 4. As can be seen from FIGS. 3 and 4, the opposed ends of the cutting arms 32, 38, and 44 may be provided with fingers 33 configured so as to overlap and mate with one another. The fingers 33 may include transverse apertures 35 therethrough for receiving a bolt or hinge pin 45 (FIG. 7), similar to the hinge pin 23 discussed above. This structure represents a specific embodiment of how the cutting arms 32, 38, and 44 may be hingedly attached in the configuration stated above. However, other approaches to hingedly attaching the cutting arms 32, 38, and 44, as will be apparent to those of skill in the art, are intended to be within the spirit and scope of this invention. In a specific embodiment, as shown in FIGS. 3 and 4, the cutting arms 32, 38, and 44 may further include cutting inserts 56 attached to leading edges 58 of the cutting arms 32, 38, and 44. In a specific embodiment, the cutting inserts 56 may be polycrystalline diamond cutter (PDC) inserts. In a specific embodiment, the at least one cutting assembly 30 may be provided without the middle cutting arm 38, in which case the second end 36 of the upper cutting arm 32 is hingedly attached to the first end 46 of the lower cutting arm 44. In this specific embodiment, either the second end 36 of the upper cutting arm 32 or the first end 40 of the lower cutting arm 44 may be configured like the first and second ends 40 and 42 of the middle cutting arm 38.

Figure 5:
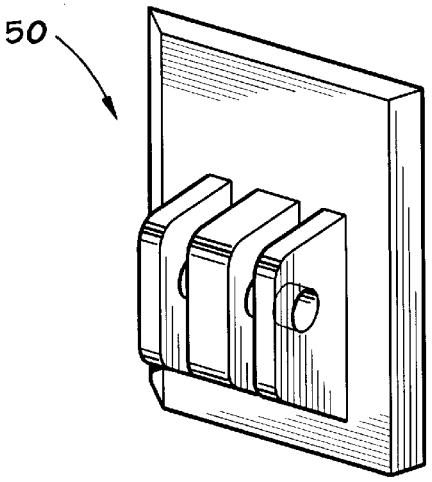
FIG. 5 illustrates a beveled attachment of the apparatus of the present invention.
Figure 6:
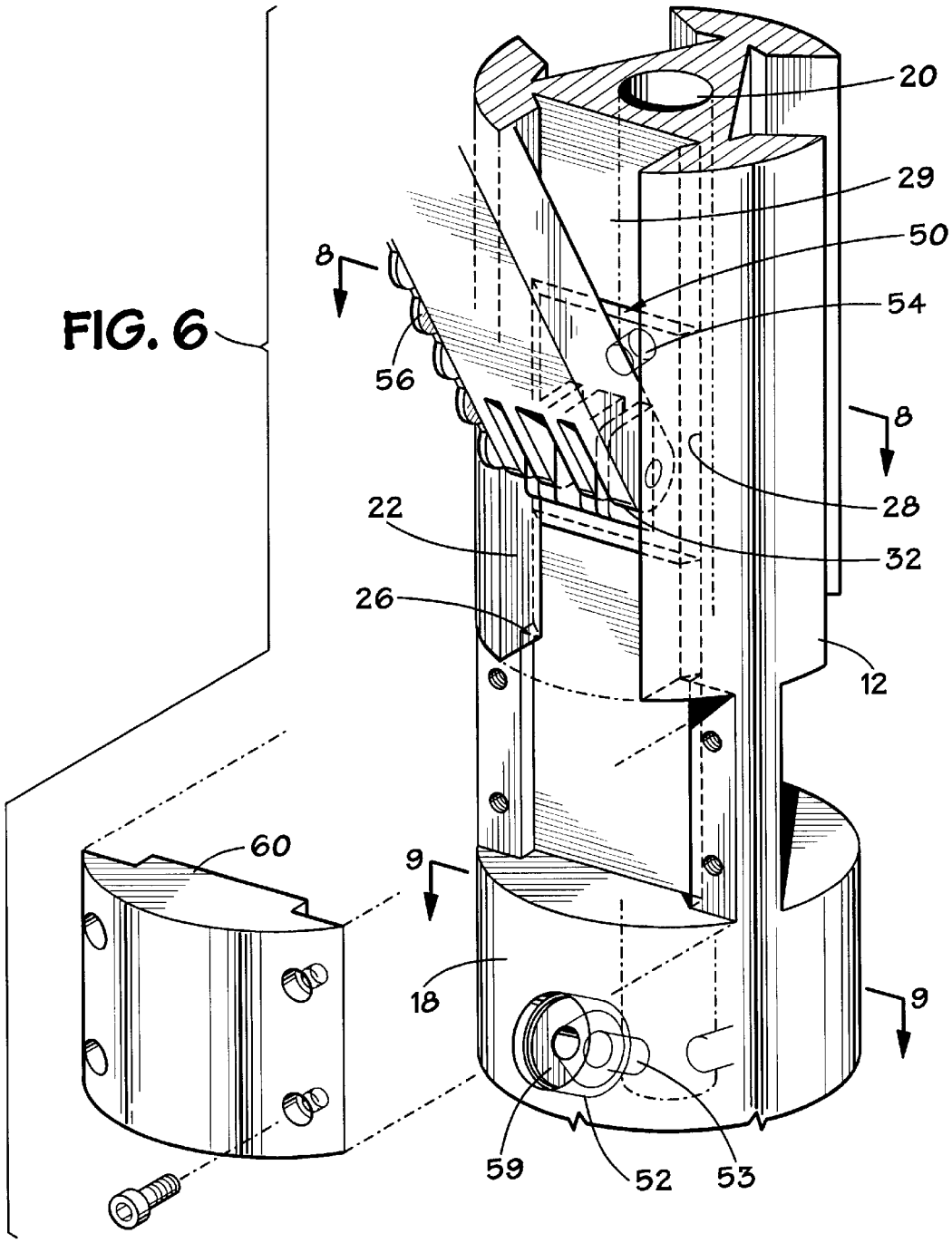
FIG. 6 is a perspective view of a lower portion of the apparatus of the present invention, and illustrates the beveled attachment attached to the lower cutting arm and located in a beveled groove within the apparatus.
Figure 8:
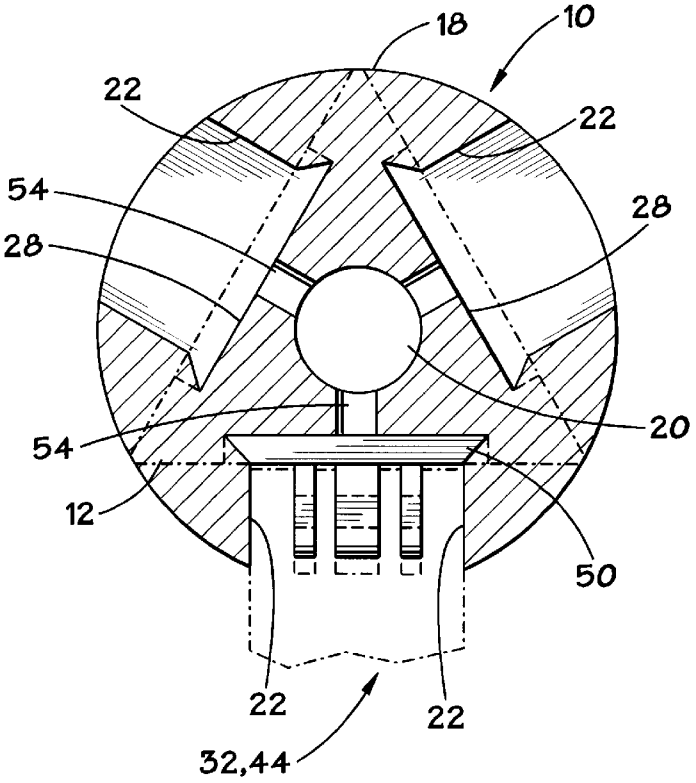
FIG. 8 is a cross-sectional view taken along line 8—8 of FIG. 6.
Figure 7:
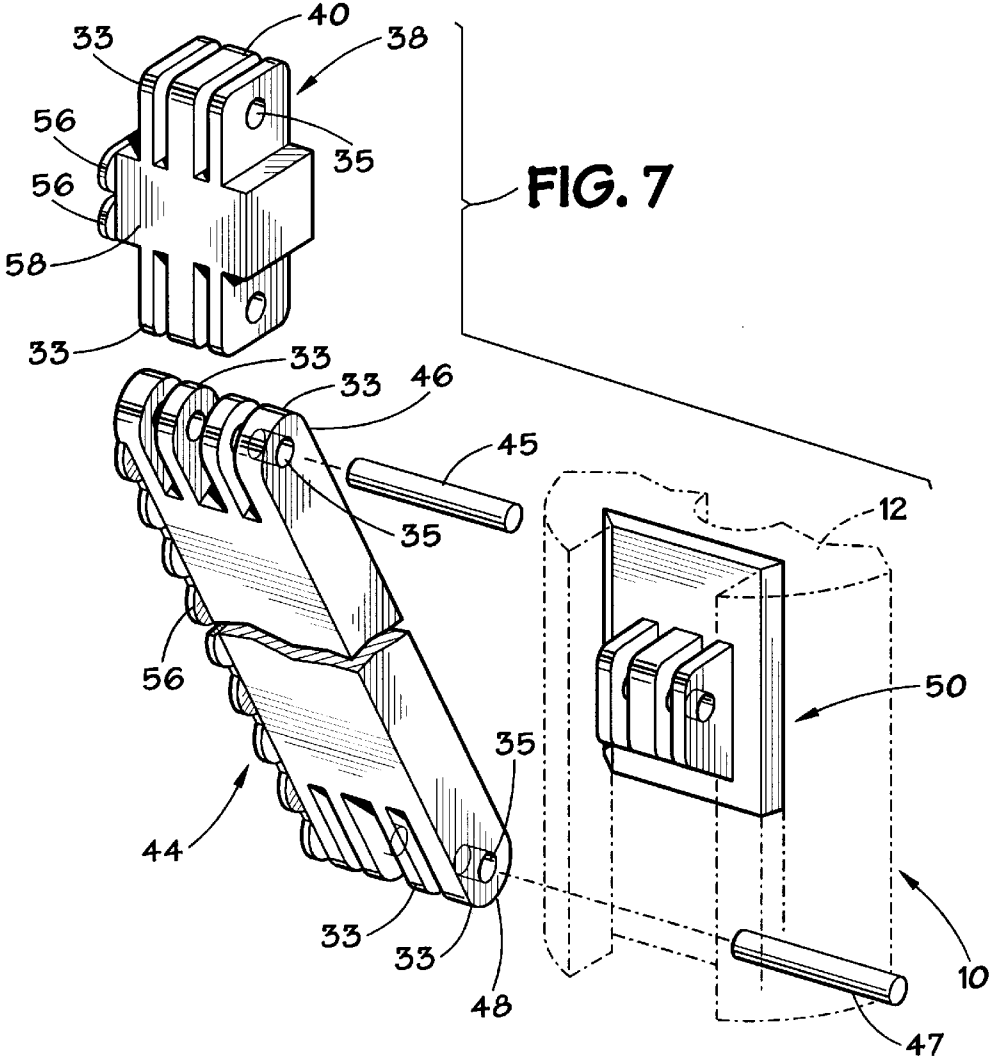
FIG. 7 is an exploded view showing the manner in which the middle and lower cutting arms are hingedly attached and the manner in which the lower cutting arm and the beveled attachment are hingedly attached.
Figure 10:
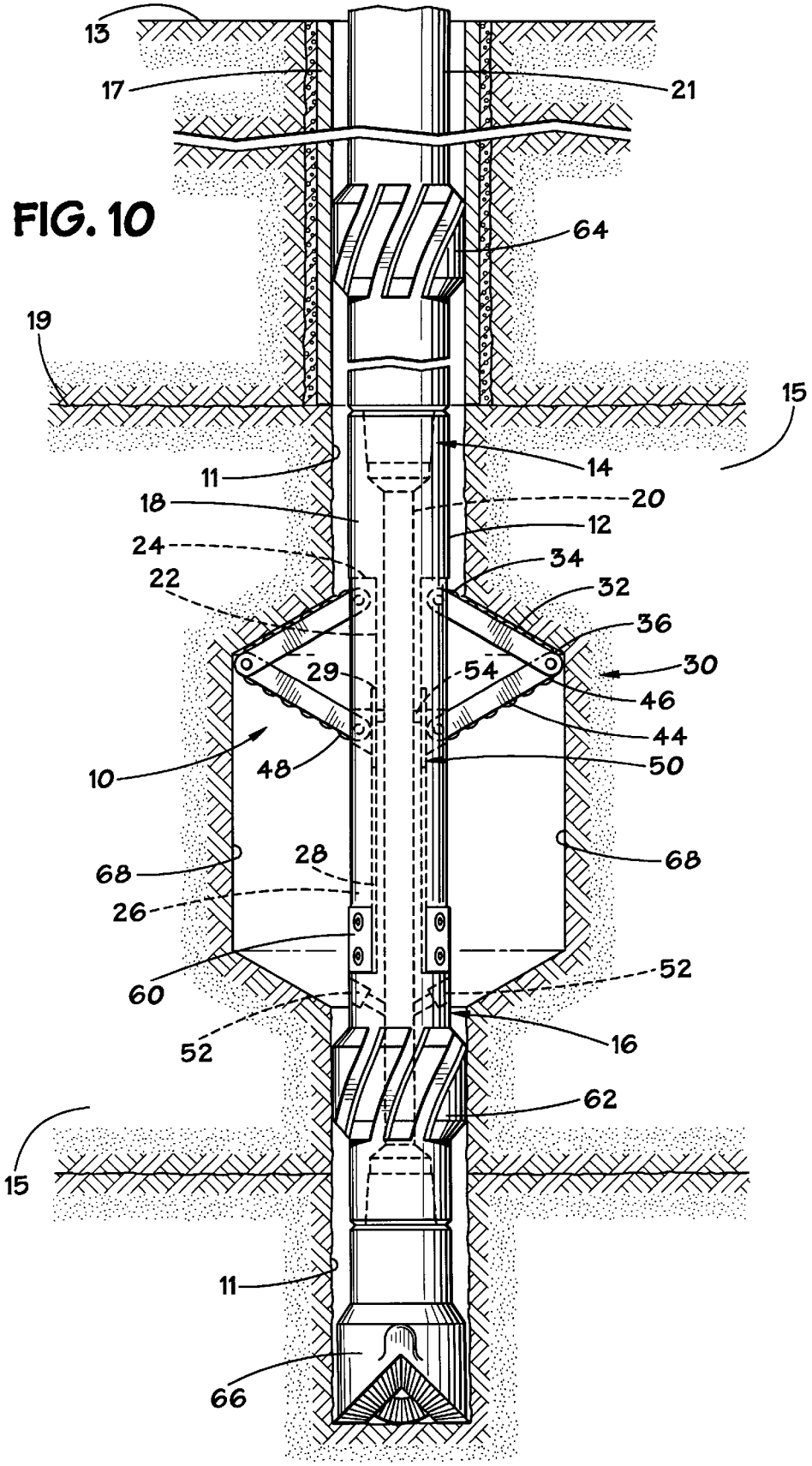
FIG. 10 is a longitudinal view of an alternate embodiment of the present invention.

In a specific embodiment, the apparatus 10 may also include a beveled attachment 50 (best shown FIG. 5) disposed for longitudinal movement within the beveled groove 28 (as shown in FIGS. 6–8). The beveled attachment 50 is hingedly attached to the second end 48 of the lower cutting arm 44. In a specific embodiment, the beveled attachment 50 may be hingedly attached to the lower cutting arm 44 with a hinge pin 47 (FIG. 7) in a manner similar to that explained above regarding the hinged attachment of the cutting arms 32, 38, and 44.

With reference to FIGS. 1, 6 and 9, the apparatus 10 may also include at least one fluid flowpath 52 disposed in the body member 12 below the at least one cutting assembly 30. The at least one fluid flowpath 52 establishes fluid communication between the longitudinal bore 20 and the outer surface 18 of the body member 12. In a specific embodiment, as shown in FIG. 9, the at least one fluid flowpath 52 may include a first section 53, a second section 55, and a shoulder 57 disposed between the first and second sections 53 and 55. In this embodiment, the apparatus 10 further includes a replaceable jet nozzle 59 having an inwardly flared aperture 65. The nozzle 59 may be of the type used in drilling bits; replaceable jet nozzles for use in drilling bits are well known to those of skill in the art. The nozzle 59 is removably received within the second section 55 of the at least one fluid flowpath 52. In this embodiment, the second section 55 further includes an annular groove 61 for receiving a snap ring 63. The jet nozzle 59 is held in place between the shoulder 57 and the snap ring 63, when the snap ring 63 is seated within the annular groove 61. Fluid flowing from the longitudinal bore 20 into the inwardly flared aperture 65 will exit the nozzle 59 at an increased velocity. In a specific embodiment, the flowpath 52 may be angled upwardly away from the longitudinal bore 20 to the outer surface 18 of the body member 12. In a specific embodiment, the angle of the flowpath 52 may correspond to the angle of the lower cutting arm 44 when in its fully-deployed position, as shown in FIG. 1. By angling the flowpath 52 upwardly, drilling fluid being circulated during the drilling operation from the earth's surface down through the longitudinal bore 20 and into the flowpath 52 will be directed upwardly under increased velocities to carry away debris, loose rock, cuttings, etc. being loosening by the cutting arms 32, 38, and 44 during operation of the apparatus 10.

In a specific embodiment, as shown in FIGS. 1, 6 and 8, the apparatus 10 may further include at least one aperture 54 disposed in the body member 12 adjacent a first end 29 of the beveled groove 28. The at least one aperture 54 establishes fluid communication between the longitudinal bore 20 and the first end 29 of the beveled groove 28. As will be more fully explained below, during the operation of the apparatus 10, when the at least one cutting assembly 30 is enlarging a wellbore hole/shaft and is in the process of being retracted from a run-in position to a fully-deployed position, as shown in FIG. 1, a portion of the fluid being pumped down the longitudinal bore 20 will pass through the aperture 54 and into the wellbore hole 11. However, when the at least one cutting assembly 30 is in its fully-deployed position (as shown in FIG. 1), the beveled attachment 50 will have been slidably moved upwardly within the beveled groove 28 so as to cover the aperture 54 and thereby restrict fluid flow therethrough. Upon this occurrence, fluid pressure within the longitudinal bore 20 will slightly increase. This slight increase in fluid pressure is detected at the earth's surface 13 to provide an indication that the at least one cutting assembly 30 is in its fully-deployed position, and the next step in the drilling operation, to be discussed below, may be carried out.

As best shown in FIG. 6, the apparatus 10 may be provided with an access plate 60 that may be removably attached to the body member 12 adjacent the second end 26 of the at least one cutting-arm slot 22 to allow insertion of the beveled attachment 50 into the beveled groove 28. In a specific embodiment, as shown in FIG. 1, the body member 12 may also be provided with an open hole stabilizer 62 disposed about the outer surface 18 of the body member 12 to stabilize the apparatus 10 when rotating within the wellbore hole 11. Similarly, in a specific embodiment, casing stabilizers, such as a grooved rubber stabilizer 64 shown in FIG. 1, may be connected to the drill string 21 to which the apparatus 10 is connected to provide additional stabilization during operation of the apparatus 10. The casing stabilizers are preferably spaced approximately 15 feet apart and are sufficient in number to accommodate the length of the hole to be enlarged, as will be understood to those of skill in the art. In a specific embodiment, the apparatus 10 may also include a pilot bit 66 attached to the second end 16 of the body member 12, as shown in FIG. 1. In a specific embodiment, the pilot bit 66 may be of the type—as known to those of ordinary skill in the art—having one or more jet nozzles through which drilling fluid may flow. Preferably, the exit diameter of the jet nozzles in the pilot bit 66 is less than the exit diameter of the jet nozzles 59.

After the drill string 21 has been lowered into the casing 17, and the apparatus 10 is located adjacent the formation 15, the process of rotating the drill string 21 and apparatus 10 is commenced. In this manner, the at least one cutting assembly 30 is activated under centrifugal force. Hydraulic horsepower is generated by pumping a drilling medium (e.g., mud, oil, air, foam, gas, etc.) from the earth's surface 13 down the interior of the drill string 21, through the longitudinal bore 20 of the apparatus 10. As explained above, a portion of the drilling medium will flow through the aperture 54, until being covered up by the beveled attachment 50, a portion of the drilling medium will flow through the at least one flowpath 52 located beneath the at least one cutting assembly 30, and the remainder will flow through the jet nozzles in the pilot bit 66. The purpose of circulating the drilling medium through the apparatus 10 is to carry away the cuttings (loose soil, rocks, debris, etc.) generated during the drilling operation. As the apparatus 10 begins to rotate, the at least one cutting assembly 30 is gradually deployed from the at least one cutting arm slot 22. As it is deployed, the cutting assembly 30 gradually enlarges the size of the well bore hole 11 until the cutting assembly 30 reaches its fully-deployed position, as shown in FIG. 1.

As the at least one cutting assembly 30 is being deployed, the upper cutting arm 32 rotates outwardly about its first end 34, and the second end 48 of the lower cutting arm 44, along with the beveled attachment 50, proceeds upwardly within the at least one cutting arm slot 22 and beveled groove 28, respectively. During this time, a small amount of drilling fluid is allowed to escape from the longitudinal bore 20 through the aperture 54 at the top of the beveled groove 28. However, when the beveled attachment 50 reaches the top of the groove 28, the beveled attachment 50 will stop moving upwardly and cover the aperture 54 so as to block the flow of drilling fluid therethrough. This will cause an increase in drilling fluid pressure, which can be monitored at the earth's surface, and will provide an indication to the operator that the at least one cutting assembly 30 has reached its fully-deployed position. At this point, with the drill string 21 still rotating, a downward axial load is placed on the drill string 21 to force the apparatus 10 downwardly, thereby enlarging the well bore hole 11 still further, as shown in FIG. 1. When the hole has been expanded to the desired size, rotation of the drill string 21 is stopped, at which time the at least one cutting assembly 30 is retracted under the force of gravity into its at least one cutting arm slot 22, and the drill string 21 and apparatus 10 are removed from the well bore hole 11, leaving the well bore hole 11 with an enlarged drainage surface 68, as shown in FIG. 1.

At a minimum, the apparatus 10 of the present invention may be used to enhance the production of an existing well, a newly-drilled well, or a mining shaft. The existing well may have been an "open hole" well—which is a well that is not provided with casing adjacent the formation from which fluids/minerals are to be produced —such as the wellbore hole 11 shown in FIG. 1. Alternatively, the existing well may have been previously completed by providing perforations through the casing adjacent the producing formation to provide a route for fluids to flow. In this latter instance, before the apparatus 10 of the present invention may be utilized, a section of the casing adjacent the formation must be removed. This is accomplished by lowering a milling tool (not shown) into the casing and milling out a section of casing adjacent the producing formation, in a manner well known to those of skill in the art. The apparatus 10 is then used as described above to enlarge the drainage surface of the well.

Thus, in accordance with the present invention, the drainage surface within a new or previously-existing well or shaft from which fluids/minerals may be produced may be considerably enhanced, thereby increasing the production capacity of the well/shaft.

It is to be understood that the invention is not limited to the exact details of construction, operation, exact materials or embodiments shown and described, as obvious modifications and equivalents will be apparent to one skilled in the art. For example, while the groove 28 and associated attachment 50 are shown in a beveled configuration, it is not intended that the invention be limited to the illustrated beveled configuration, but that the invention covers other configurations (e.g., squared, rounded, etc.) of the groove 28 and the attachment 50. It is further contemplated that the present invention may be used in environments other than the oil and gas, water well, or mining applications. For example, the present invention may also be used in the construction industry and may also have medical applications. In these applications, the apparatus would naturally be constructed on a much smaller or "miniaturized" scale, and the drilling medium could be air. The device could be used in the construction industry, for example, to enlarge a hole within a wall. The device could be used in the medical field, for example, during arthroscopic surgery. Accordingly, the invention is therefore to be limited only by the scope of the appended claims.

I claim:

1. An apparatus for enhancing production from a wellbore hole, comprising:

a body member having a first end, a second end, an outer surface, a longitudinal bore extending therethrough, at least one cutting-arm slot disposed longitudinally in the outer surface of the body member, the cutting-arm slot having a first end and a second end, and a groove disposed adjacent the second end of the at least one cutting-arm slot;

at least one cutting assembly disposed within the at least one cutting-arm slot, the at least one cutting assembly including:

an upper cutting arm having a first end and a second end, the first end of the upper cutting arm being hingedly attached to the body member adjacent the first end of the at least one cutting-arm slot;

a middle cutting arm having a first end and a second end, the first end of the middle cutting arm being hingedly attached to the second end of the upper cutting arm; and, a lower cutting arm having a first end and a second end, the first end of the lower cutting arm being hingedly attached to the second end of the middle cutting arm, and the second end of the lower cutting arm being slidably and hingedly attached to the body member; and an attachment disposed for longitudinal movement within the groove and hingedly attached to the second end of the lower cutting arm.

2. The apparatus of claim 1, wherein the body member further includes at least one aperture adjacent a first end of the groove, the at least one aperture establishing fluid communication between the longitudinal bore and the first end of the groove, the aperture being covered by the attachment when the at least one cutting arm assembly is in a fully-deployed position thereby prohibiting communication of fluid from the longitudinal bore through the aperture and causing an increase in fluid pressure within the longitudinal bore, the pressure increase providing an indication that the at least one cutting arm assembly is in its fully-deployed position.

3. The apparatus of claim 1, further including an access plate removably attached to the body member adjacent the second end of the at least one cutting-arm slot to allow insertion of the attachment into the groove.

4. The apparatus of claim 1, wherein the groove and attachment are beveled.

5. The apparatus of claim 1, further including at least one fluid flowpath disposed in the body member below the at least one cutting assembly, the at least one fluid flowpath establishing fluid communication between the longitudinal bore and the outer surface of the body member.

6. The apparatus of claim 5, wherein the at least one fluid flow path is upwardly angled away from the longitudinal bore to the outer surface of the body member.

7. The apparatus of claim 5, wherein the at least one fluid flow path is flared inwardly from the longitudinal bore to the outer surface of the body member.

8. The apparatus of claim 5, wherein the at least one fluid flowpath includes a first section, and a second section, the apparatus further including a replaceable jet nozzle having an inwardly flared aperture, the jet nozzle being removably received within the second section of the at least one fluid flowpath.

9. The apparatus of claim 8, wherein the at least one fluid flowpath further includes a shoulder disposed between the first and second sections, the second section further including an annular groove for receiving a snap ring, the jet nozzle being held in place between the shoulder and the snap ring when the snap ring is seated within the annular groove.

10. The apparatus of claim 1, wherein the cutting arms further include cutting inserts attached to leading edges of the cutting arms.

11. The apparatus of claim 1, wherein the body member includes three cutting assemblies disposed in three cutting-arm slots, the three cutting-arm slots being spaced apart equally about the circumference of the body member.

12. The apparatus of claim 1, wherein the body member includes an access bore and a threaded bore adjacent the first end of the at least one cutting-arm slot, the apparatus further including a hinge pin having a threaded end for mating with the threaded bore and a head end to be received in the access bore, the hinge pin passing through an aperture in the first end of the upper cutting arm.

13. The apparatus of claim 1, further including an open hole stabilizer disposed about the outer surface of the body member to stabilize the apparatus during operation.

14. The apparatus of claim 1, further including a pilot bit attached to the second end of the body member.

15. An apparatus for enhancing production from a wellbore hole, comprising:

a body member having a first end, a second end, an outer surface, a longitudinal bore extending therethrough, at least one cutting-arm slot disposed longitudinally in the outer surface of the body member, the cutting-arm slot having a first end and a second end, and a groove disposed adjacent the second end of the at least one cutting-arm slot;

at least one cutting assembly disposed within the at least one cutting-arm slot, the at least one cutting assembly including:

an upper cutting arm having a first end and a second end, the first end of the upper cutting arm being hingedly attached to the body member adjacent the first end of the at least one cutting-arm slot; and, a lower cutting arm having a first end and a second end, the first end of the lower cutting arm being hingedly attached to the second end of the upper cutting arm, and the second end of the lower cutting arm being slidably and hingedly attached to the body member; and an attachment disposed for longitudinal movement within the groove and hingedly attached to the second end of the lower cutting arm.

16. The apparatus of claim 15, wherein the body member further includes at least one aperture adjacent a first end of the groove, the at least one aperture establishing fluid communication between the longitudinal bore and the first end of the groove, the aperture being covered by the attachment when the at least one cutting arm assembly is in a fully-deployed position thereby prohibiting communication of fluid from the longitudinal bore through the aperture and causing an increase in fluid pressure within the longitudinal bore, the pressure increase providing an indication that the at least one cutting arm assembly is in its fully-deployed position.

17. The apparatus of claim 15, further including an access plate removably attached to the body member adjacent the second end of the at least one cutting-arm slot to allow insertion of the attachment into the groove.

18. The apparatus of claim 15, wherein the groove and attachment are beveled.

19. The apparatus of claim 15, further including at least one fluid flowpath disposed in the body member below the at least one cutting assembly, the at least one fluid flowpath establishing fluid communication between the longitudinal bore and the outer surface of the body member.

20. The apparatus of claim 19, wherein the at least one fluid flow path is upwardly angled away from the longitudinal bore to the outer surface of the body member.

21. The apparatus of claim 19, wherein the at least one fluid flow path is flared inwardly from the longitudinal bore to the outer surface of the body member.

22. The apparatus of claim 19, wherein the at least one fluid flowpath includes a first section, and a second section, the apparatus further including a replaceable jet nozzle having an inwardly flared aperture, the jet nozzle being removably received within the second section of the at least one fluid flowpath.

23. The apparatus of claim 22, wherein the at least one fluid flowpath further includes a shoulder disposed between the first and second sections, the second section further including an annular groove for receiving a snap ring, the jet nozzle being held in place between the shoulder and the snap ring when the snap ring is seated within the annular groove.

24. The apparatus of claim 15, wherein the cutting arms further include cutting inserts attached to leading edges of the cutting arms.

25. The apparatus of claim 15, wherein the body member includes three cutting assemblies disposed in three cutting-arm slots, the three cutting-arm slots being spaced apart equally about the circumference of the body member.

26. The apparatus of claim 15, wherein the body member includes an access bore and a threaded bore adjacent the first end of the at least one cutting-arm slot, the apparatus further including a hinge pin having a threaded end for mating with the threaded bore and a head end to be received in the access bore, the hinge pin passing through an aperture in the first end of the upper cutting arm.

27. The apparatus of claim 15, further including an open hole stabilizer disposed about the outer surface of the body member to stabilize the apparatus during operation.

28. The apparatus of claim 15, further including a pilot bit attached to the second end of the body member.

29. A method of using a production-enhancing apparatus to enhance production from a wellbore hole, the apparatus including a body member having a first end, a second end, an outer surface, a longitudinal bore extending therethrough, and at least one cutting-arm slot disposed longitudinally in the outer surface of the body member, the cutting-arm slot having a first end and a second end, and at least one cutting assembly disposed within the at least one cutting-arm slot, the at least one cutting assembly including an upper cutting arm having a first end and a second end, the first end of the upper cutting arm being hingedly attached to the body member adjacent the first end of the at least one cutting-arm slot, and a lower cutting arm having a first end and a second end, the first end of the lower cutting arm being hingedly attached to the second end of the upper cutting arm, and the second end of the lower cutting arm being slidably and hingedly attached to the body member, the method comprising the steps of:

attaching the production-enhancing apparatus to a drill string;

lowering the drill string and production-enhancing apparatus into the wellbore hole;

positioning the production-enhancing apparatus adjacent a producing formation; and, rotating the drill string and production-enhancing apparatus to cause the at least one cutting assembly to move from a closed position to a fully-deployed position and to cut into the formation, thereby enlarging a surface drainage area of the wellbore hole.

30. The method of claim 29, further including the step of pumping a drilling medium from the earth's surface down an interior of the drill string, through a longitudinal bore of the body member, through a drilling bit attached to the second end of the body member, and back to the earth's surface through an annulus between the drill string and the wellbore hole, while the drill string is rotating, to carry away debris loosened by the cutting arms.

31. The method of claim 30, wherein the apparatus further includes at least one fluid flowpath disposed in the body member below the at least one cutting assembly, the at least one fluid flowpath establishing fluid communication between the longitudinal bore and the outer surface of the body member, and wherein the step of pumping drilling medium further includes the step of pumping drilling medium through the at least one fluid flowpath.

32. The method of claim 29, wherein the production-enhancing apparatus further includes a groove disposed adjacent the second end of the at least one cutting-arm slot, an attachment disposed for longitudinal movement within the groove and hingedly attached to the second end of the lower cutting arm, and at least one aperture adjacent a first end of the groove establishing fluid communication between the longitudinal bore and the first end of the groove, the method further including the steps of:

moving the attachment upwardly within the groove to cover the aperture when the at least one cutting arm assembly is in its fully-deployed position to thereby prohibit communication of fluid from the longitudinal bore through the aperture and causing an increase in fluid pressure within the longitudinal bore to provide an indication that the at least one cutting arm assembly is in its fully-deployed position; and, applying a downward force to the apparatus to cause the apparatus tool to move downwardly and further enlarge the wellbore hole.

33. The method of claim 29, further including the step of applying a downward force to the apparatus to cause the apparatus to move downwardly and further enlarge the wellbore hole.

34. The method of claim 29, further including the steps of:

stopping the rotation of the drill string and apparatus;

retracting the at least one cutting assembly under the force of gravity into the at least one cutting arm slot; and removing the drill string and apparatus from the wellbore hole.

35. The method of claim 29, further including the step of milling out a section of casing adjacent the producing formation prior to lowering the drill string and production-enhancing apparatus into the wellbore hole.

* * * * *